US011692345B2

(12) United States Patent
Gritcai et al.

(10) Patent No.: US 11,692,345 B2
(45) Date of Patent: Jul. 4, 2023

(54) MODULAR DYNAMIC ACOUSTIC CEILING PANEL

(71) Applicant: USG INTERIORS, LLC, Chicago, IL (US)

(72) Inventors: Oksana Gritcai, Los Angeles, CA (US); Stephen Hettwer, Chino Hills, CA (US)

(73) Assignee: USG INTERIORS, LLC, Chicago, IL (US)

( * ) Notice: Subject to any disclaimer, the term of this patent is extended or adjusted under 35 U.S.C. 154(b) by 483 days.

(21) Appl. No.: 16/916,868

(22) Filed: Jun. 30, 2020

(65) Prior Publication Data

US 2021/0404179 A1 Dec. 30, 2021

(51) Int. Cl.

| | |
|---|---|
| ***E04B 1/99*** | (2006.01) |
| ***E04B 1/84*** | (2006.01) |
| ***E04B 1/82*** | (2006.01) |
| ***E04B 9/00*** | (2006.01) |

(52) U.S. Cl.

CPC ..... *E04B 1/994* (2013.01); *E04B 1/84* (2013.01); *E04B 9/001* (2013.01); *E04B 2001/8414* (2013.01)

(58) Field of Classification Search

CPC ... E04B 1/99; E04B 1/994; E04B 1/84; E04B 1/8409; E04B 1/8236; E04B 1/8227; E04B 1/82; E04B 1/74; E04B 1/86; E04B 9/001; E04B 2001/8414

See application file for complete search history.

(56) References Cited

U.S. PATENT DOCUMENTS

| | | | | |
|---|---|---|---|---|
| 3,232,370 A * | 2/1966 | Jaffe | G10K 11/20 181/30 |
| 3,447,628 A | 6/1969 | Shiflet | |
| 3,466,830 A * | 9/1969 | Smith | E04B 9/003 160/183 |
| 3,469,354 A * | 9/1969 | Meetze, Jr. | G05D 3/14 52/6 |

(Continued)

FOREIGN PATENT DOCUMENTS

| | | | |
|---|---|---|---|
| EP | 3112546 A1 * | 1/2017 | E04B 9/0414 |
| FR | 2364309 A1 | 4/1978 | |

(Continued)

*Primary Examiner* — Edgardo San Martin

(74) *Attorney, Agent, or Firm* — Marshall, Gerstein & Borun LLP

(57) ABSTRACT

A modular dynamic acoustic system for use in connection with an indoor environment includes a movable panel array, a support structure, and a plurality of suspension members. The movable panel array includes a plurality of panel members, each of which including a body defining at least one edge, at least one hinge positioned along the at least one edge, and at least one mounting structure. The panel members are operably coupled with at least one adjacent panel member via the at least one hinge. Each of the plurality of suspension members is operably coupled with the support structure and the at least one mounting structure of one of the plurality of panel members to secure the movable panel array to the support structure. Each of the suspension members is movable to modify a configuration of the movable panel array.

13 Claims, 14 Drawing Sheets

(56) References Cited

U.S. PATENT DOCUMENTS 3,590,354 A * 6/1971 Shiflet ..... E04B 1/994 318/245
4,094,379 A 6/1978 Steinberger
4,356,880 A 11/1982 Downs
4,832,147 A 5/1989 Dear et al.
4,920,707 A * 5/1990 Moskaliuk ..... E04B 7/14 52/6
5,525,766 A * 6/1996 Atcheson ..... G10K 11/20 181/30
5,987,823 A * 11/1999 Zarnick ..... E04H 3/22 52/6
6,006,476 A 12/1999 Zarnick
6,431,312 B1 * 8/2002 D'Antonio ..... E04B 1/994 181/295
6,793,037 B1 9/2004 Babuke et al.
7,261,182 B2 8/2007 Zainea
7,520,091 B2 * 4/2009 Friedman ..... E04B 7/163 52/63
7,604,094 B2 10/2009 Magyari
7,703,575 B2 4/2010 Berger, II et al.
8,028,791 B2 * 10/2011 Kliegle ..... E04B 9/001 52/22
8,079,192 B2 * 12/2011 Gerkes ..... E04B 9/14 52/506.07
8,960,367 B1 2/2015 Leclerc
9,260,863 B2 2/2016 Thun et al.
10,907,349 B2 * 2/2021 Fang ..... E04B 9/0435
11,286,666 B2 * 3/2022 Brett ..... E04B 9/34
2008/0271395 A1 * 11/2008 Stackenwalt ..... E04B 9/30 52/222
2019/0292774 A1 * 9/2019 Durali ..... E04B 1/994
2021/0404179 A1 * 12/2021 Gritcai ..... E04B 9/20

FOREIGN PATENT DOCUMENTS

GB 375726 A 6/1932
WO WO-03035991 A2 * 5/2003 ..... E04B 9/00
WO WO-2004022874 A1 3/2004

* cited by examiner

MODULAR DYNAMIC ACOUSTIC CEILING PANEL

FIELD OF THE DISCLOSURE

The present disclosure generally relates to acoustic ceiling panels for selectively adjusting acoustic and aesthetic characteristics of an environment.

BACKGROUND

Indoor or interior environments are used to accommodate varying numbers of occupants. In some environments, contemporary acoustic design elements may be used to alter acoustic characteristics of the environment and to create a more aesthetically pleasing environment that is welcoming and inviting for occupants. Some of these systems incorporate movement and/or adjustability to selectively adjust the acoustic characteristics of the environment. Such systems typically require a customized design that is tailored for the particular environment. Typically, in these systems, a number of different acoustic elements such as panels are paired together to create a larger overall acoustic array. More specifically, manufacturers may take end-user requirements for each unique project and build solutions that are optimized to each individual project. In essence, upon determining requirements of a particular project, manufacturers design an appropriate chassis, which is oftentimes a time-consuming, inefficient process due to the inability to rely on previous designs for guidance and/or standards. Further, these systems oftentimes require extensive time and resources to install and configure in the desired environment. Additionally, due to the varying shapes and/or configurations of the individual panel members, such systems typically have high associated storage costs and can necessitate a number of different mounting and/or actuating structures, which may further increase manufacturing and storage costs. Last, while these existing systems may provide acoustic improvements to the environment, they may not provide a desired aesthetically pleasing environment that is visually inviting for occupants.

SUMMARY

In accordance with one embodiment of the present disclosure, a modular dynamic acoustic system for use in connection with an indoor environment includes a movable panel array, a support structure, and a plurality of suspension members. The movable panel array includes a plurality of panel members, each of which including a body defining at least one edge, at least one hinge positioned along the at least one edge, and at least one mounting structure. The panel members are operably coupled with at least one adjacent panel member via the at least one hinge. Each of the plurality of suspension members is operably coupled with the support structure and the at least one mounting structure of one of the plurality of panel members to secure the movable panel array to the support structure. Each of the suspension members is movable to modify a configuration of the movable panel array.

In some examples, the at least one hinge of each of the plurality of panel members is integrally formed with the body and includes at least one barrel portion and at least one gap portion. The at least one barrel portion of a first panel member is adapted to be disposed in the at least one gap portion of the adjacent panel member when operably coupled together. In some examples, the at least one mounting structure includes an opening formed on a portion of the body of the panel member.

In some of these examples, each of the plurality of panel members includes a hinge mounting portion positioned along the at least one edge to secure the hinge to the panel member. The at least one mounting structure may include an opening formed between adjacent panel members. The opening may be adapted to receive a ball member including an eye bolt coupled thereto.

In some examples, the modular dynamic acoustic system may further include an actuation mechanism operably coupled with the plurality of suspension members. The actuation mechanism is adapted to selectively move each of the plurality of suspension members to modify the configuration of the movable panel array. In some of these examples, the actuation mechanism includes a cam member having a plurality of lobes that engage the plurality of suspension members to adjust a length of the plurality of suspension members to move the panel array in a predefined manner. In other examples, the actuation mechanism includes a controller operably coupled with each of the plurality of suspension members.

In some examples, the body of the plurality of panel members is constructed from a sound-absorbing material. Further, in some examples, each of the plurality of panel members has a triangular shape.

In accordance with another aspect of the present disclosure, a movable panel array for a modular dynamic acoustic system includes a plurality of panel members. Each of the plurality of panel members includes a body defining at least one edge, at least one hinge positioned along the at least one edge, and at least one mounting structure. Each of the plurality of panel members are operably coupled with at least one adjacent panel member via the at least one hinge.

BRIEF DESCRIPTION OF THE DRAWINGS

The above approaches are at least partially met through provision of the dynamic acoustic ceiling panel described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, a modular dynamic acoustic ceiling system includes a number of panelized elements that can be operably and movably coupled to each other to form a movable array having acoustic and aesthetic modifying capabilities. The movable array is suspended from a generally overhead support structure (e.g., a ceiling structure) via a number of suspension members that serve the additional purpose of being adjustable to differing lengths. The relative adjustments between the suspension members causes the movable array to move or alter its shape, which in turn alters an acoustic characteristic of the environment. For example, the movable array may be moved to increase an amount of sound absorbed to assist in reducing an overall volume of the environment. Further, such a system may serve to enhance an overall visual appeal of an environment.

Figure 1:
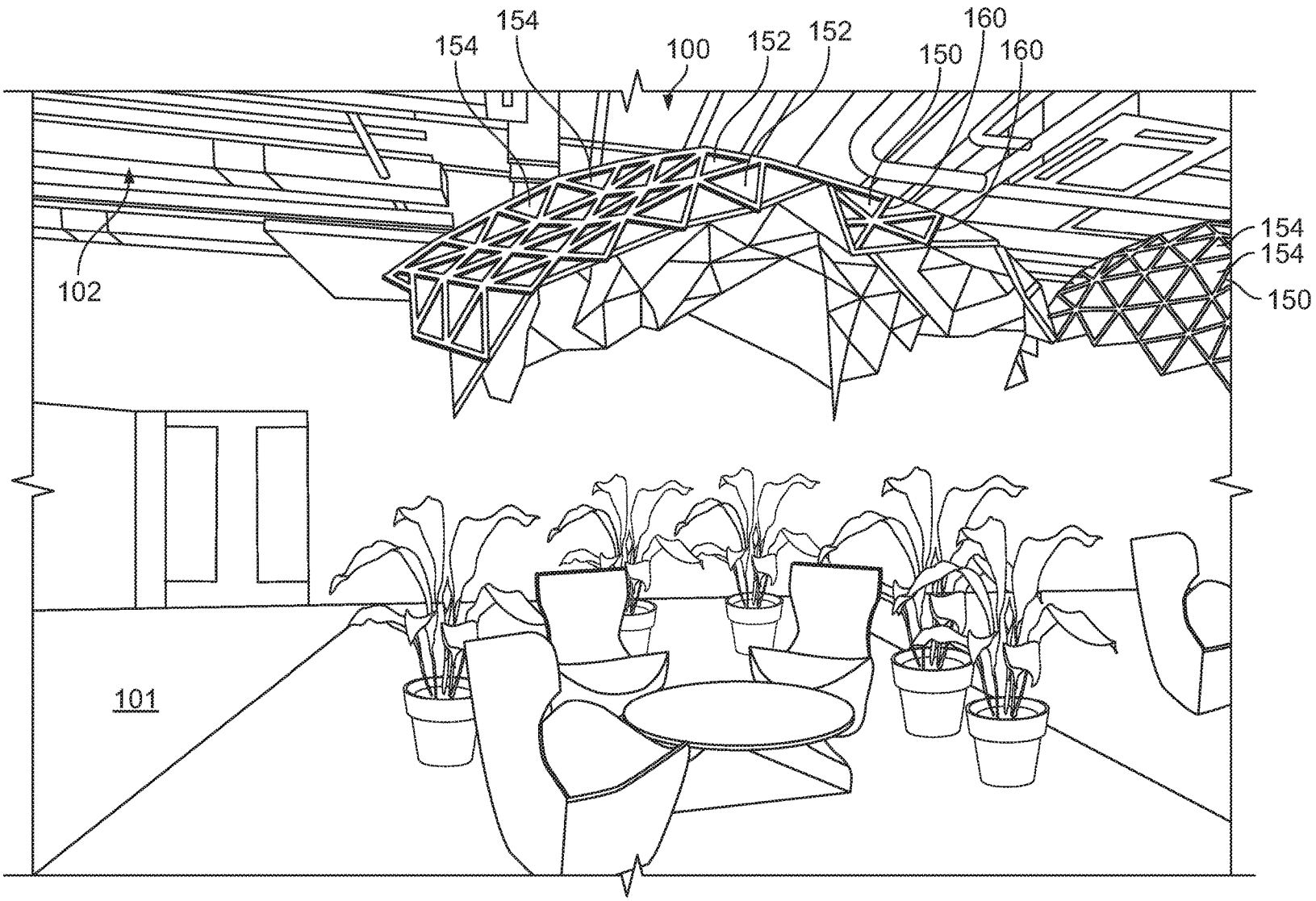
FIG. 1 illustrates a perspective view of an example indoor environment having an example modular dynamic acoustic system in in accordance with various embodiments of the present disclosure.
Figure 2A:
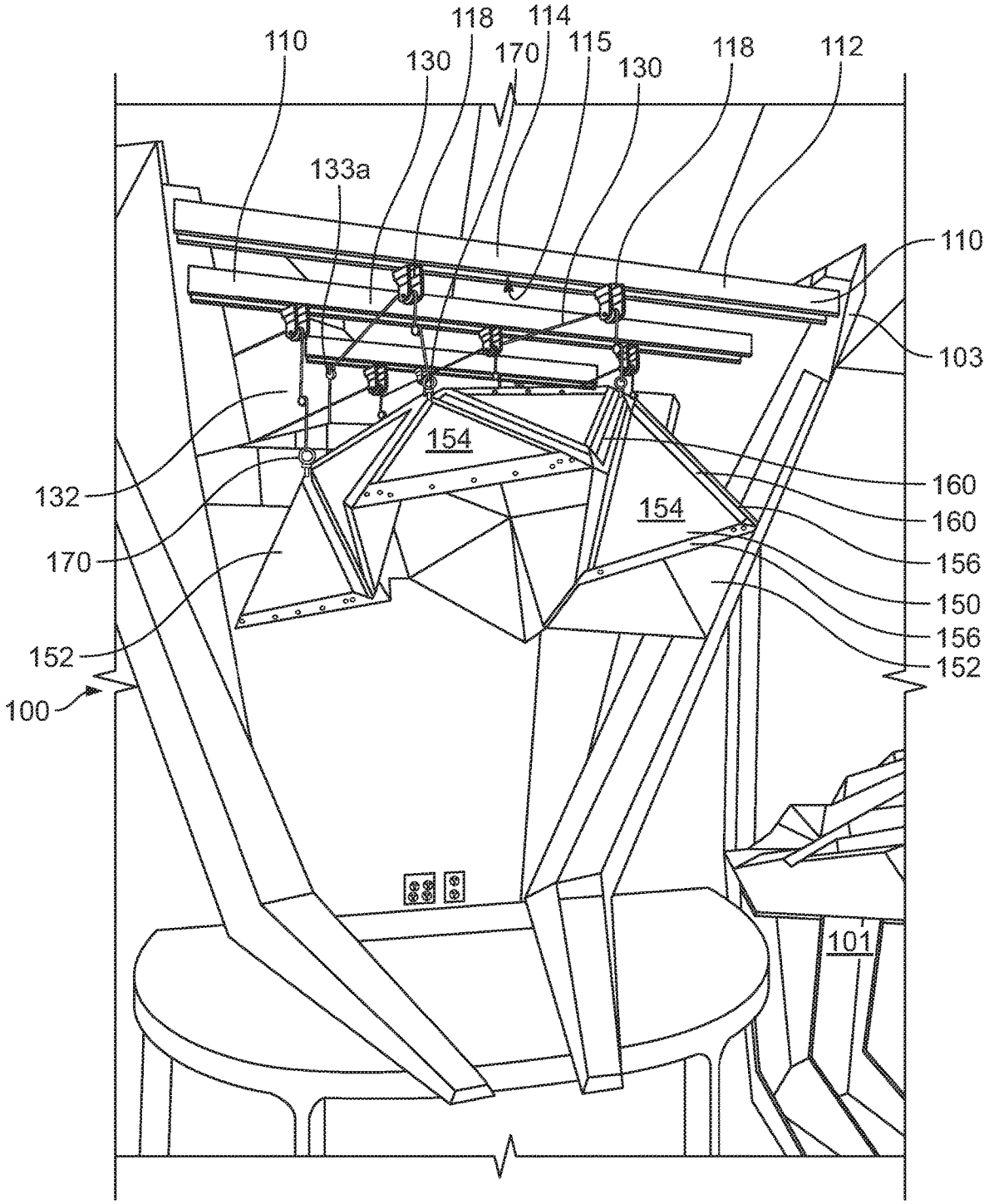
FIG. 2*a* illustrates a perspective view of the example modular dynamic acoustic system of FIG. 1 coupled to a display structure in a first configuration in accordance with various embodiments of the present disclosure.
Figure 2B:
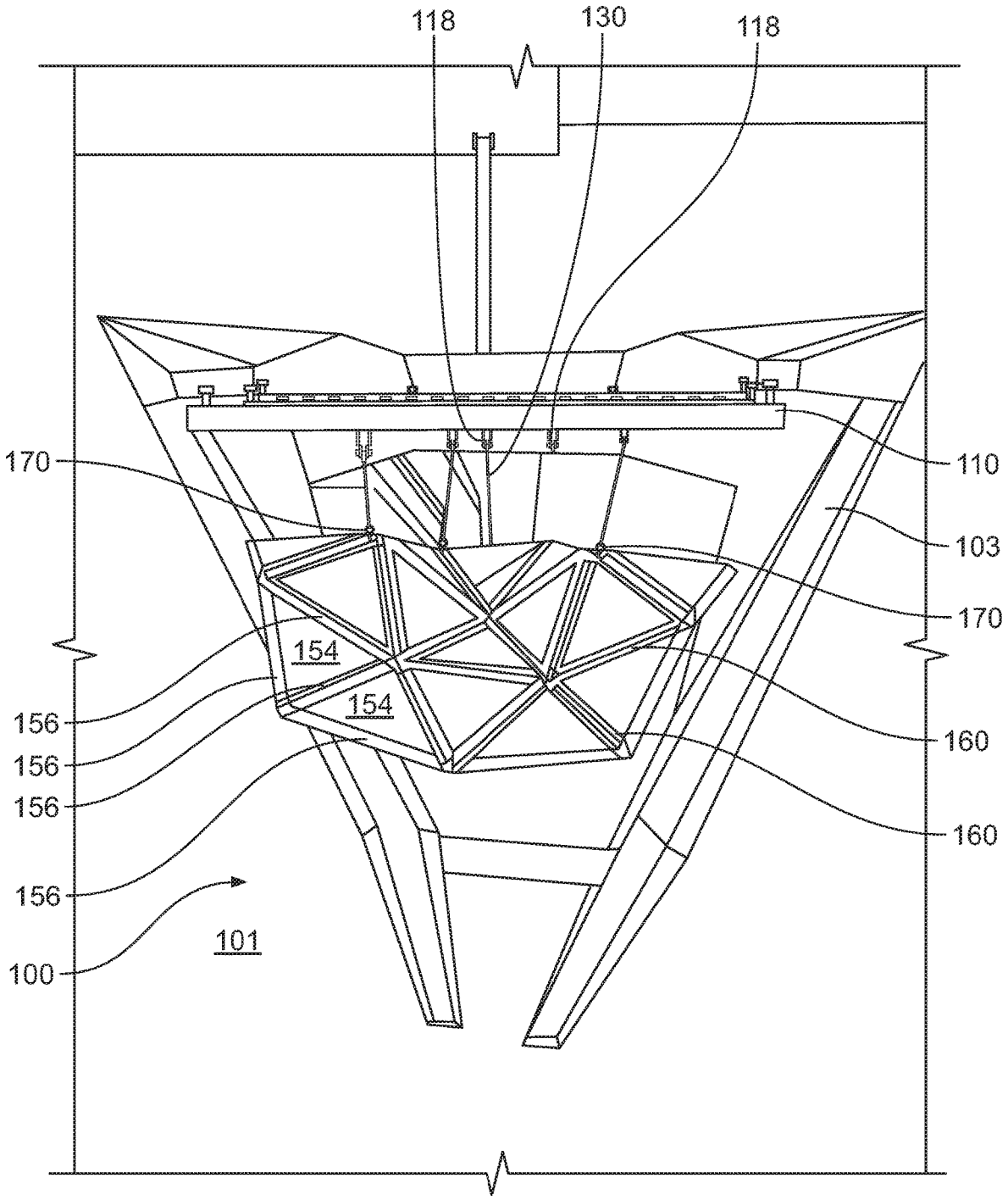
FIG. 2*b* illustrates a perspective view of the example modular dynamic acoustic system of FIGS. 1 and 2*a* coupled to a display structure in a second configuration in accordance with various embodiments of the present disclosure.

Referring now to the drawings, a dynamic acoustic and aesthetic system 100 is provided for use in connection with an indoor environment 101 having a ceiling member 102 (FIG. 1) or similar overhanging display structure 103 (FIGS. 2*a*-8*b*). It is noted that the overhanging display structure 103 provided in FIGS. 2*a*-8*b* includes similar components to the system 100 used in conjunction with a ceiling member 102, and the overhanging display structure 103 is illustrated for the purpose of providing a clearer visualization of additional components in the system 100. Further, it is appreciated that the system 100 may also be used in an outdoor environment having appropriate mounting structures.

Generally, the system 100 includes a support structure 110, a number of suspension members 130, and a movable panel array 150. The support structure 110 is operably coupled with the ceiling 102 (or the overhanging display structure 103) and is capable of supporting the weight of the movable panel array 150. In some examples, the support structure 110 may be in the form of a strut or beam system that couples with and/or is a portion of an overhead structural beam system (e.g., an I-beam system; not illustrated). One such example of a support structure 110 is a metal framing member provided by Unistrut.

Figure 3:
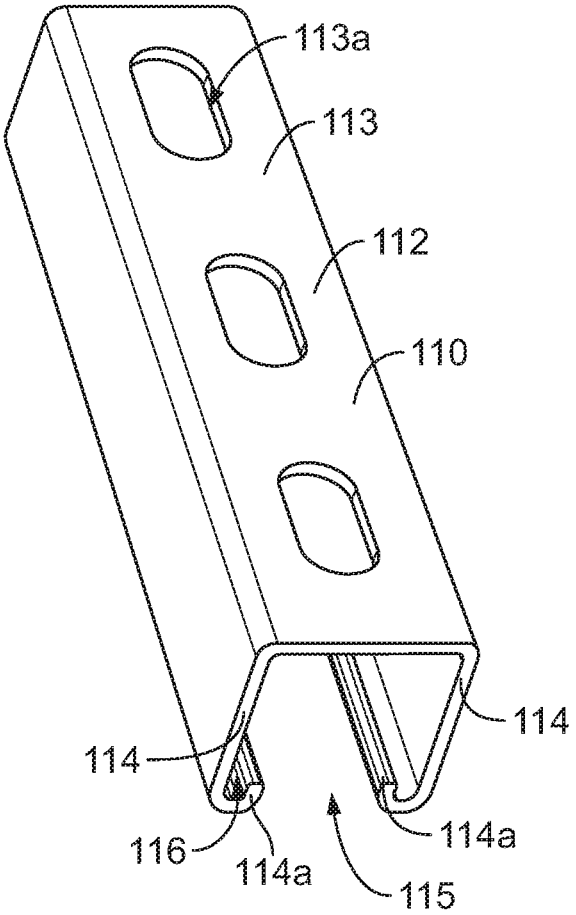
FIG. 3 illustrates an example support structure for use with the example modular dynamic acoustic system of FIGS. 1-2*b* in accordance with various embodiments of the present disclosure.
Figure 4:
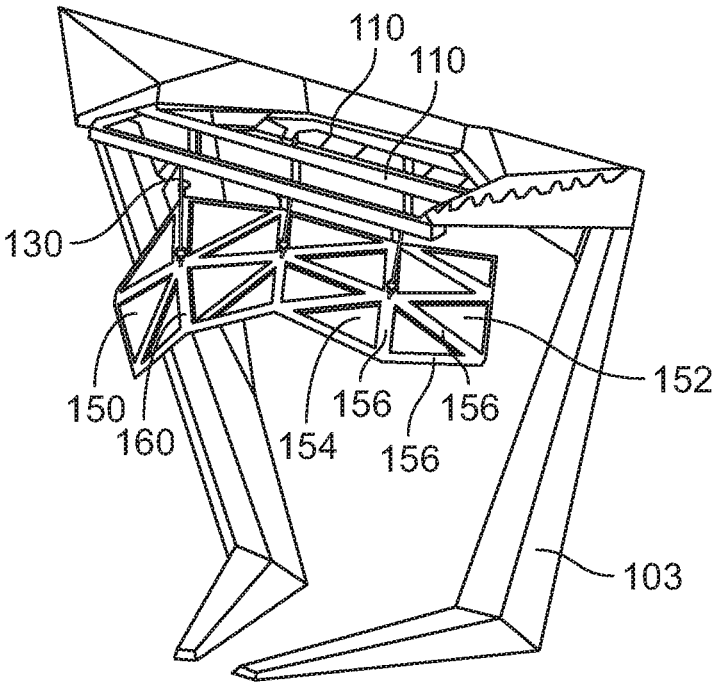
FIG. 4 illustrates a perspective view of the example modular dynamic acoustic system of FIGS. 1-3 in accordance with various embodiments of the present disclosure.

With reference to FIG. 3, the support structure 110 is in the form of an elongated member 112 having a base 113 and any number of sidewalls 114 that define an inner channel 115. Further, the sidewalls 114 may include a curved end portion 114*a* that defines a track 116. In some examples, the base 113 of the elongated member 112 may be secured to the ceiling 102 (or the overhanging display structure 103) via any number of suitable approaches such as, for example, by inserting bolts through openings 113*a* formed on the base 113. In some examples, the elongated member 112 may be mounted via other suitable structural mounting elements. In the examples illustrated in FIG. 2*a*-8*b*, the ends of the elongated member 113 may be secured to the overhanging display structure 103 via any number of approaches such as, for example, brackets, flanges, columns, and the like. It is appreciated that any number of support structures 110 may be used as desired depending on the size and/or configuration of the movable panel array 150.

With reference to FIGS. 2*a*-5*a* and 8*b*, any number of pulleys 118 are provided that are operably coupled with the support structure 110. More specifically, the pulley 118 includes a mounting member 119 that is insertable into the inner channel 115 of the elongated member 112. In some examples, the mounting member 119 may be in the form of a mounting wheel or similar component that rests on and/or is engaged with the curved end portions 114*a* of the sidewalls 114 and may be at least partially disposed within the track 116 to limit its relative movement. Other examples of suitable mounting members 119 are possible. The pulley 118 may additionally include a main wheel 120 that is coupled with and suspended below the mounting member 119.

The suspension members 130 may be in the form of an elongated rope having a first end 130*a*, a second end 130*b*, and a length 130*c* extending therebetween. In some examples, the suspension members may be constructed from a metal, a polymer, a polymeric and/or elastomeric material, or any suitable combination of these and/or other similar materials. Generally, the first end 130*a* of the suspension member 130 is operably coupled with the movable panel array 150, a portion of the length 130*c* engages the support structure 110 (e.g., the main wheel 120 of the pulley 118), and the second end 130*b* may be engaged to adjust a length thereof positioned below the pulley 118.

Figure 5A:
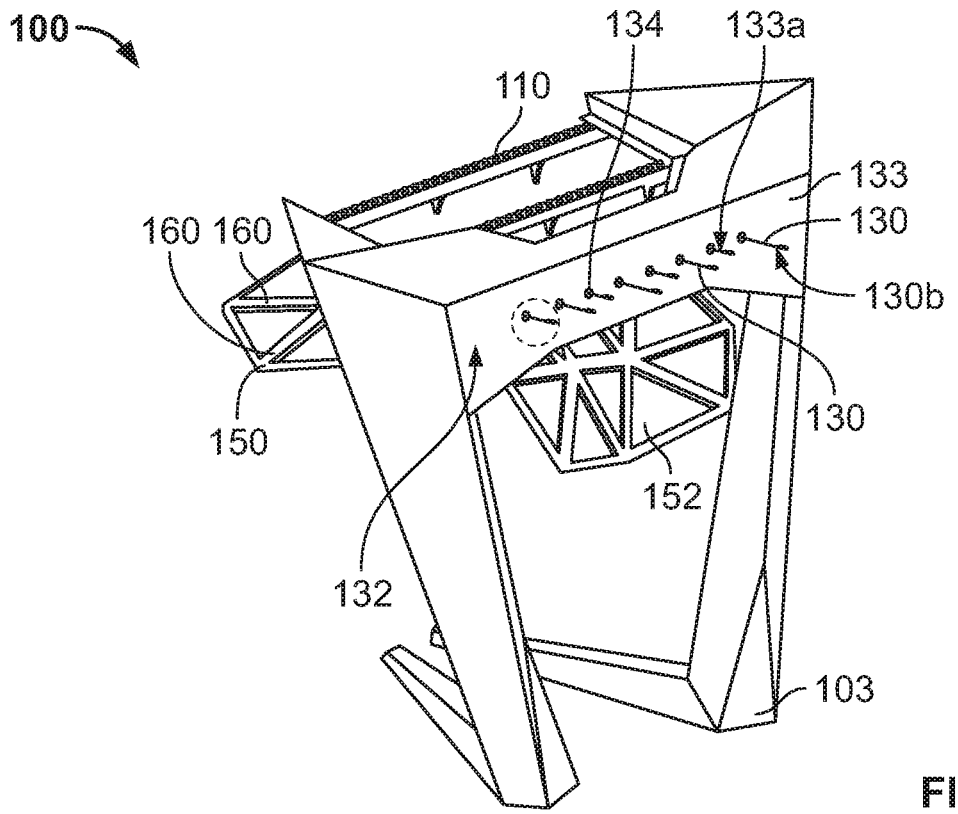
FIG. 5*a* illustrates a rear perspective view of the example modular dynamic acoustic system of FIGS. 1-4 having an actuation mechanism in accordance with various embodiments of the present disclosure.
Figure 5B:
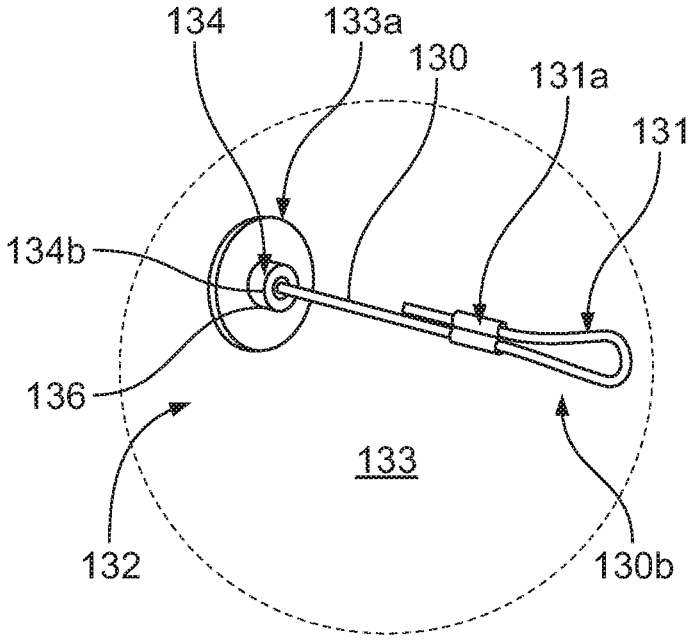
FIG. 5*b* illustrates a close up rear perspective view of a support structure for the example modular dynamic acoustic system of FIGS. 1-5*a* in accordance with various embodiments of the present disclosure.
Figure 6:
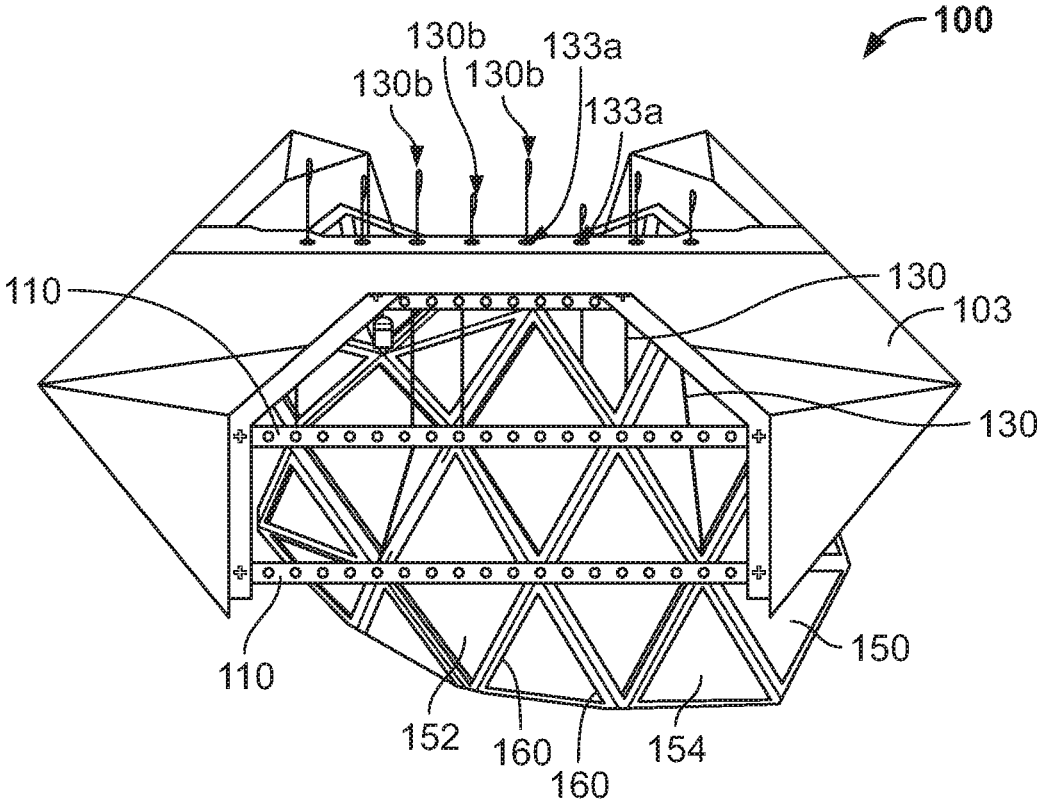
FIG. 6 illustrates a top plan view of the example modular dynamic acoustic system of FIGS. 1-5*b* in accordance with various embodiments of the present disclosure.
Figure 7:
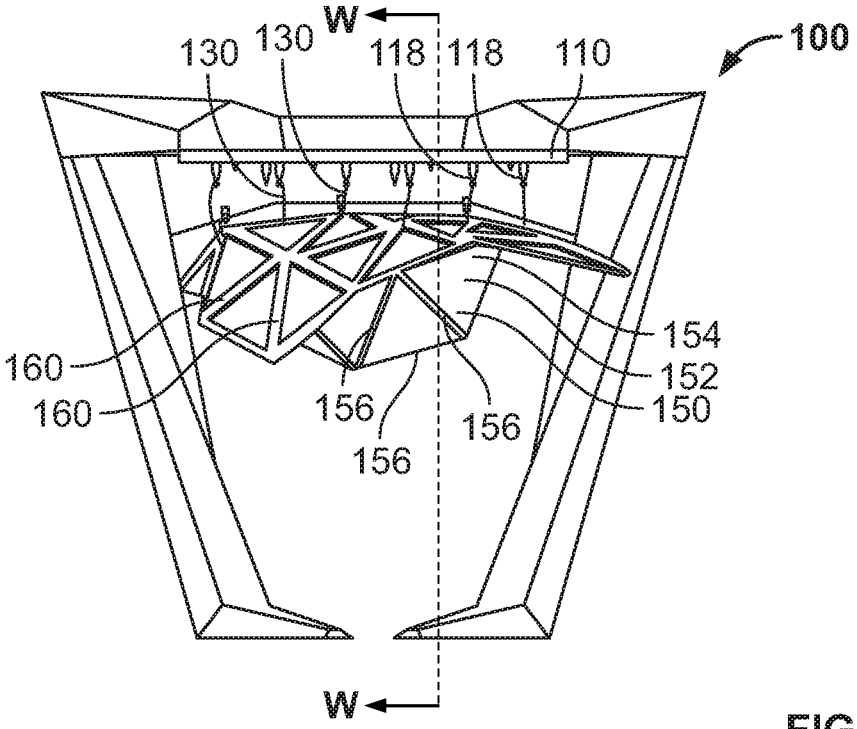
FIG. 7 illustrates a front elevation view of the example modular dynamic acoustic system of FIGS. 1-6 in accordance with various embodiments of the present disclosure.
Figure 8A:
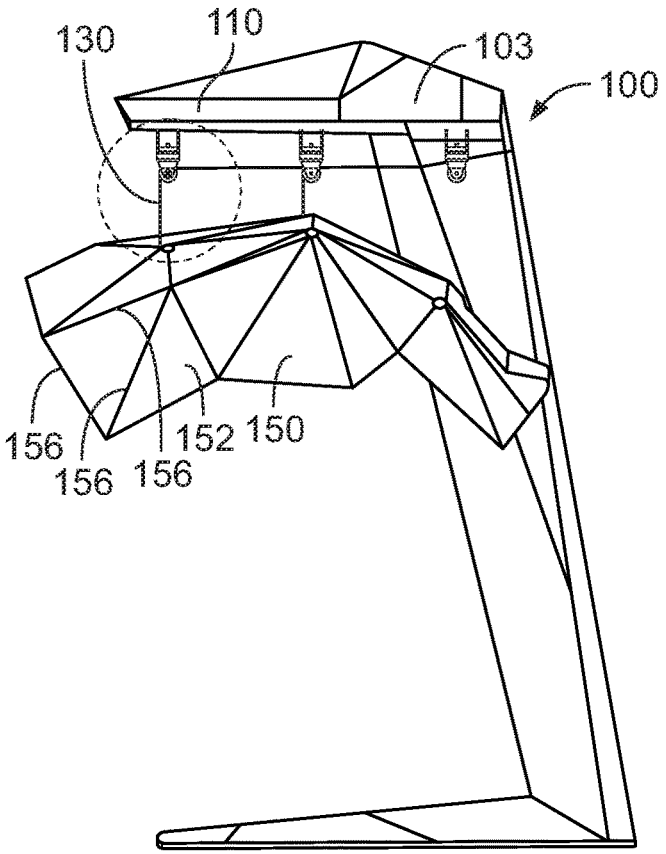
FIG. 8*a* illustrates a right cross-sectional elevation view of the example modular dynamic acoustic system of FIGS. 1-7 taken along line W-W in accordance with various embodiments of the present disclosure.
Figure 8B:
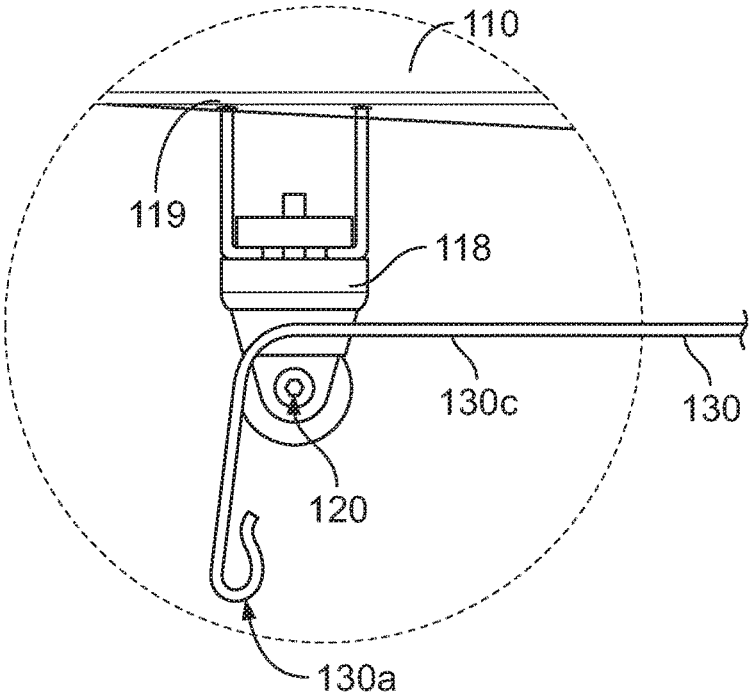
FIG. 8*b* illustrates a close up right elevation view of the example modular dynamic acoustic system of FIGS. 1-8*a* in accordance with various embodiments of the present disclosure.
Figure 9:
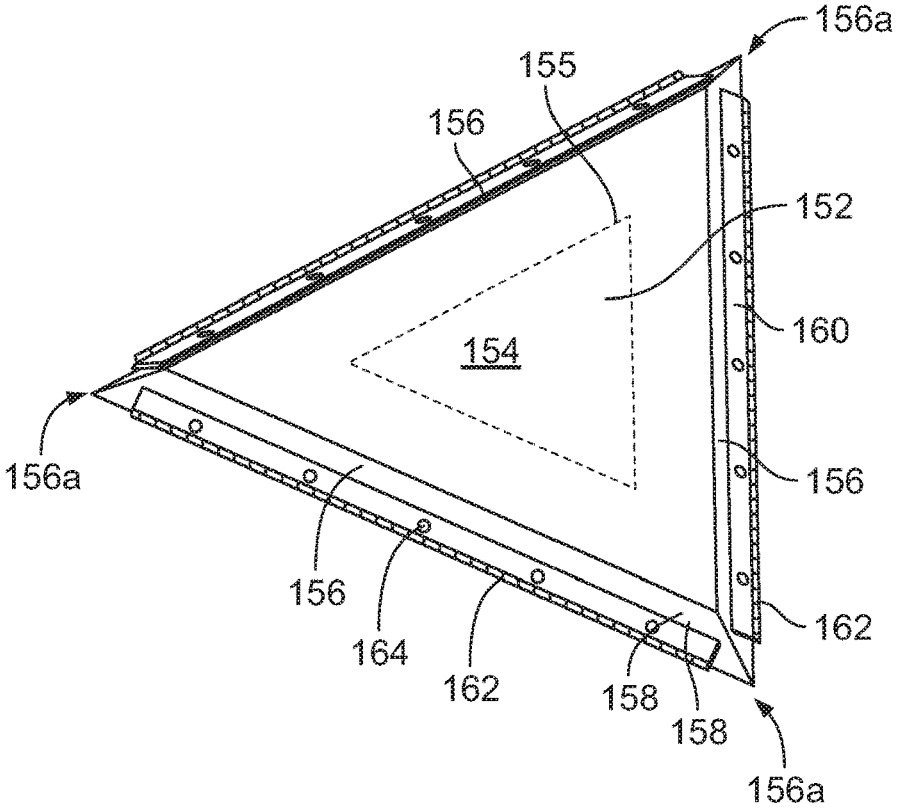
FIG. 9 illustrates a perspective view of an example panel member of the example modular dynamic acoustic system of FIGS. 1-8*b* in accordance with various embodiments of the present disclosure.

In some examples, the suspension member 130 may be routed through the inner channels 115 of the elongated members 112 to a mounting portion 132 positioned at a centralized location in the environment 101. In other examples and as illustrated in FIGS. 4-8*b*, the suspension member 130 may not be routed through the inner channels 115, and rather, the length 130*c* thereof may be disposed below the support structures until the second end 130*b* engages the mounting portion 132. With particular reference to FIGS. 5*a*-6, the mounting portion 132 includes a wall 133 having any number of openings 133*a* through which the second ends 130*b* of the suspension members 130 are inserted and further includes a securement feature 134. In some examples, the second ends 130*b* of the suspension members 130 may form a loop 131 that is secured via a band 131*a* (e.g., a crimped bracket member). Other examples are possible.

In some approaches, the securement feature 134 is in the form of a collar that is insertable into the opening 133*a* of the wall 133. The collar 134 extends in a longitudinal direction and defines an inner opening 134*a* that also extends in the longitudinal direction. Further, the collar 134 includes an opening 134*b* that extends from an outer surface thereof transverse and through the opening 134*a*. A set screw 136 is insertable into the opening 134*b*.

As previously noted, the second end 130*b* of the suspension member 130 is inserted through the opening 133*a* of the wall 133 and is also inserted through the opening 134*a* of the collar 134. A user may selectively engage the suspension member 130 to adjust a length thereof that extends below the pulley 118. When a desired length 130*c* of the suspension member extending downwardly from the pulley 118 is obtained, the set screw 136 is inserted into the opening 134*b* until abutting and retaining the suspension member 130 in the desired position. Upon coupling the set screw 136 with the collar 134, the set screw 136 prevents the suspension member 130 from moving through the opening 133*a* of the wall 133.

With reference to FIGS. 1-11, the movable panel array 150 includes a number of panel members 152. The panel members 152 in the illustrated examples are generally triangular in shape, but in other examples, the panel members 152 may take any desired shape or configuration. Each of the panel members 152 includes a body 154 that defines any number of edges 156 (e.g., three), any number of corners 156*a* (e.g., three), and a number of mounting holes 158, and at least one hinge member 160.

The panel members 152 may be constructed or formed from a formed and/or stamped sheet of metal, a polymeric material, glass, or any combination of these and/or other suitable materials. The panel members 152 may have any desired dimension such as, for example an equilateral triangle having sides of approximately 30 inches. Other examples are possible. In some forms, an acoustically absorbing and/or an insulative material 155 (FIG. 9) may be coupled with and/or adhered to all or a portion of the body 154. In some cases, the panel members 152 may be perforated with openings on the surface to further allow sound waves to reach the acoustically absorbing and/or insulative material 155. In some of these examples, the acoustically absorbing and/or insulative material 155 may be in the form of a foam member, a polymeric member, a synthetic member, a recycled denim product, and the like. Other examples are possible. In yet other examples, the body 154 may itself be constructed from an acoustically absorbing and/or an insulative material.

The movable panel array 150 is modular because any number of desired panel members 152 may be operably coupled with each other. In some examples, the panel members 152 may all be identical or substantially identical, and as such, may result in reduced manufacturing costs, increased efficiency, and/or decreased storage costs due to not requiring a cataloging and/or inventory system for different configurations thereof.

In the illustrated embodiment, the mounting holes 158 are positioned near the edges 156 of the body 154. The hinge member 160 is used to rotatably couple adjacent panel members 152. In the illustrated examples, the hinge member 160 is in the form of an elongated bracket having a central hinge portion 162 and mounting wings 164. Each of the mounting wings 164 includes a number of holes 166 that are aligned with the mounting holes 158 formed on the body 154 of the panel members 152. Accordingly, the hinge member 160 may be coupled to first and second panel members 152 by securing one of the mounting wings 164 thereof to the mounting holes 158 via screws, fasteners, and the like. Other examples are possible.

Upon securing the hinge member 160 to the panel members 152, adjacent panel members 152 will be rotatably coupled to each other. As such, the adjacent panel members 152 may rotate relative to each other about the hinge portion 162 of the hinge member 160. As illustrated in the Figures, any number of panel members 152 may be coupled with each other via hinge members 160 to form a panel array 150 having any desired size, shape, and/or configuration. Accordingly, the movable panel array 150 is modular and can be quickly modifiable as desired.

Figure 10:
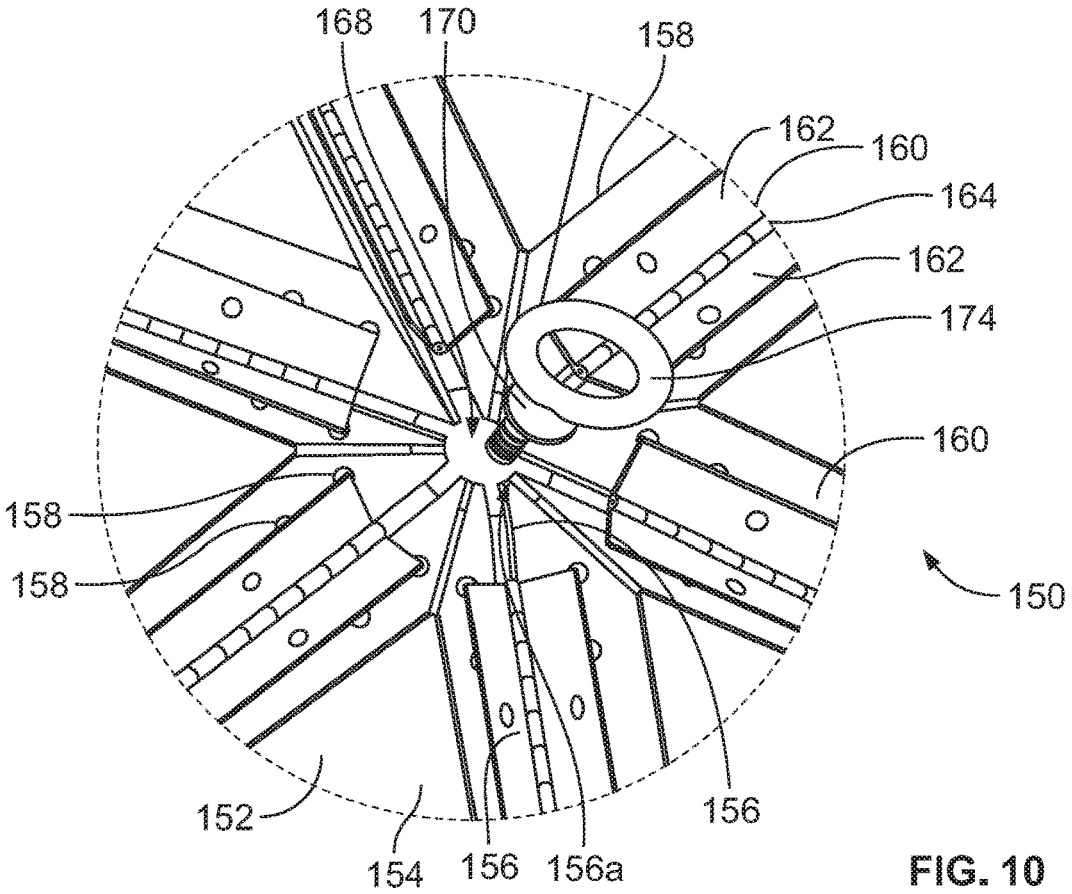
FIG. 10 illustrates a close up perspective view of a plurality of example panel members of the example modular dynamic acoustic system of FIGS. 1-9 forming a movable panel array in accordance with various embodiments of the present disclosure.
Figure 11:
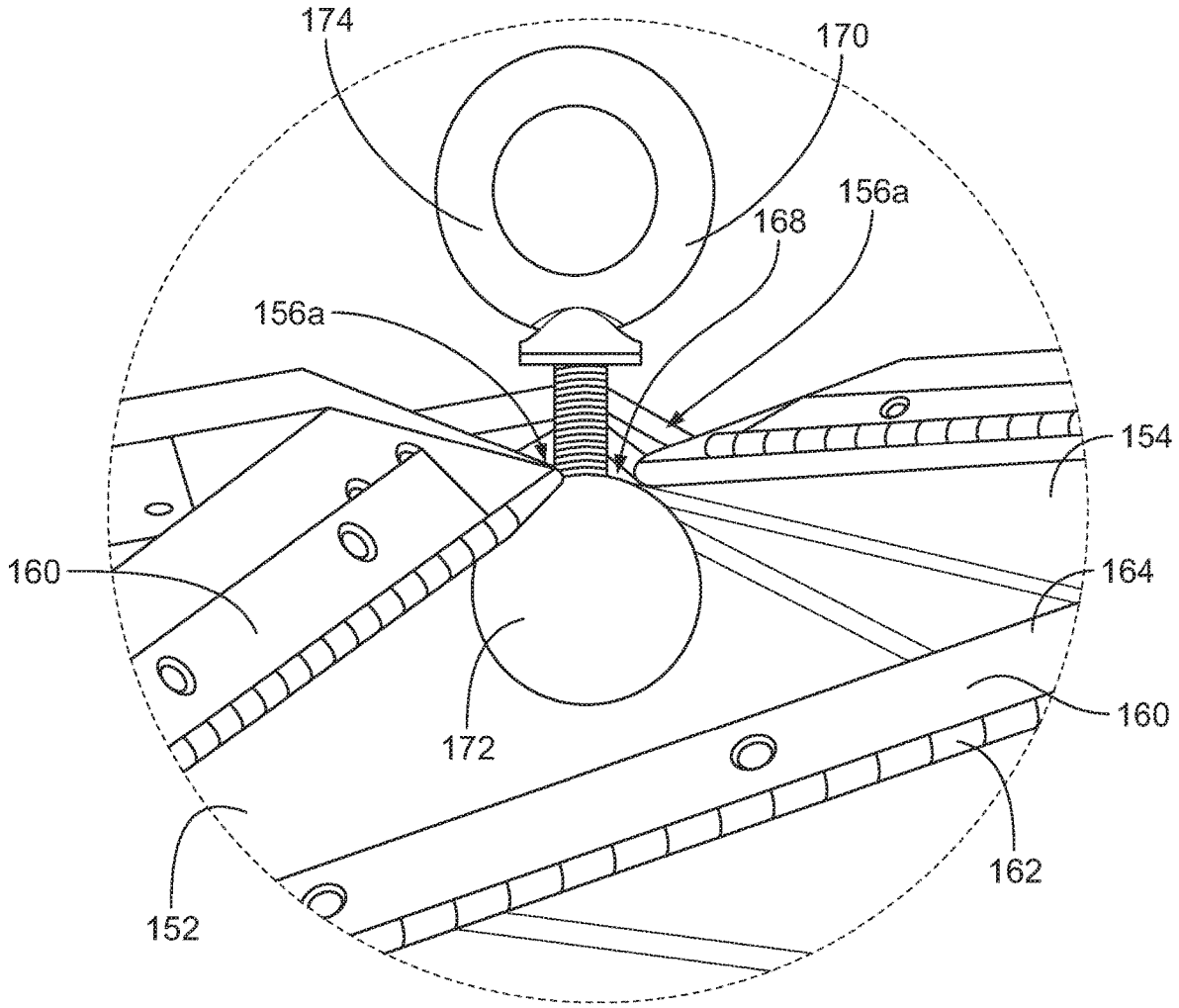
FIG. 11 illustrates a close up side elevation view of a plurality of example panel members of the example modular dynamic acoustic system of FIGS. 1-10 in accordance with various embodiments of the present disclosure.
Figure 12:
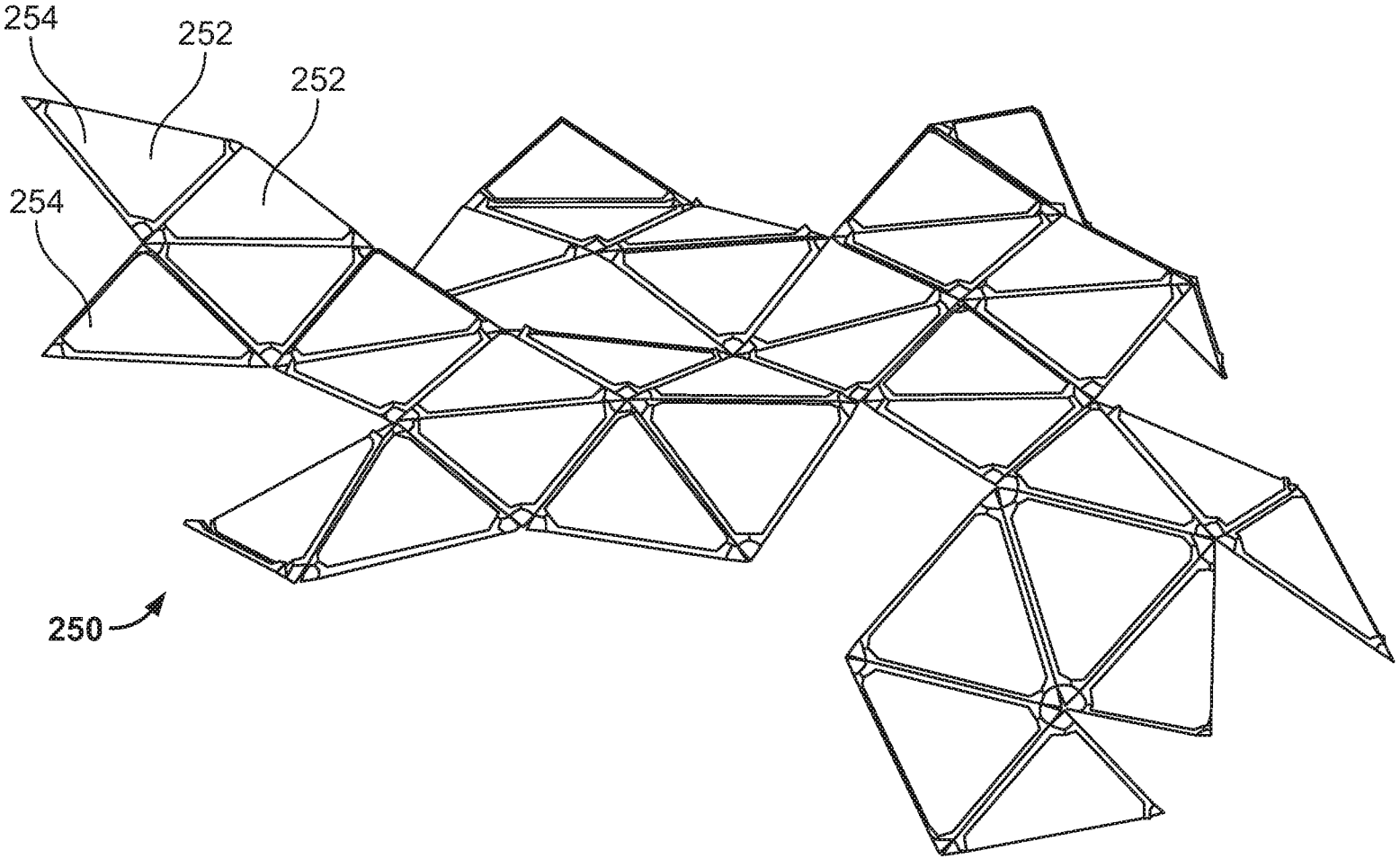
FIG. 12 illustrates a perspective view of a second example movable panel array including a second example panel member for use with the example modular dynamic acoustic system in accordance with various embodiments of the present disclosure.
Figure 13:
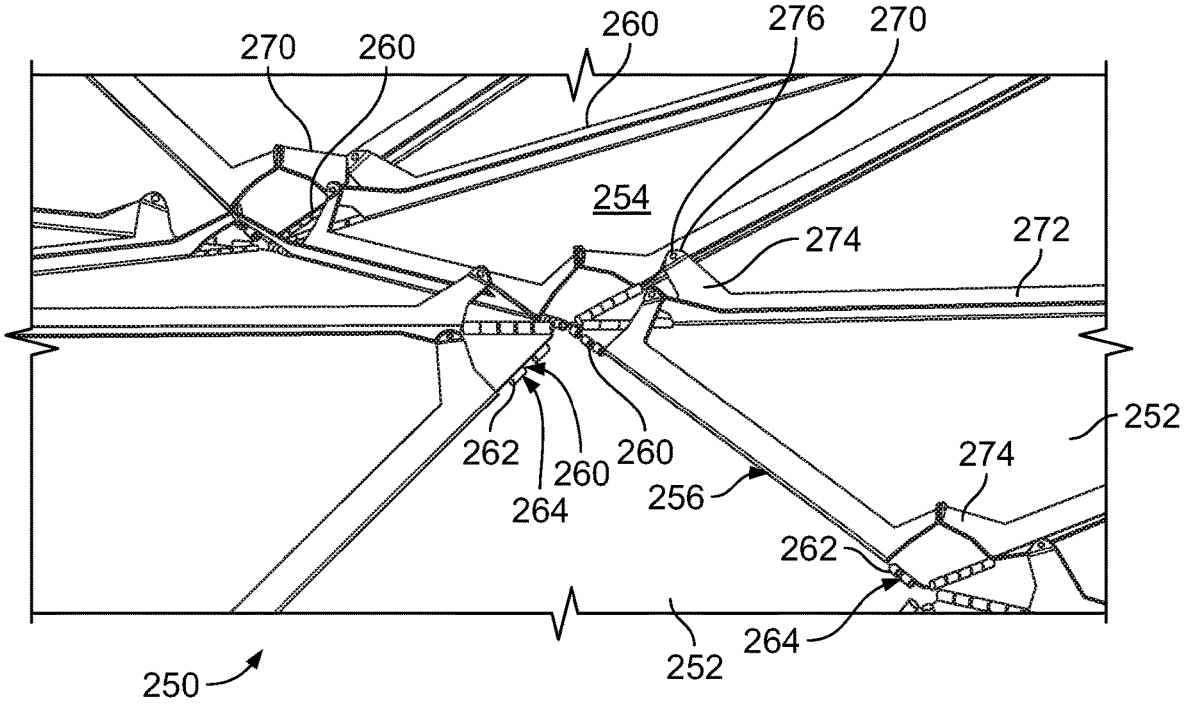
FIG. 13 illustrates a close up perspective view of the second example movable panel array of FIG. 12 in accordance with various embodiments of the present disclosure.
Figure 14:
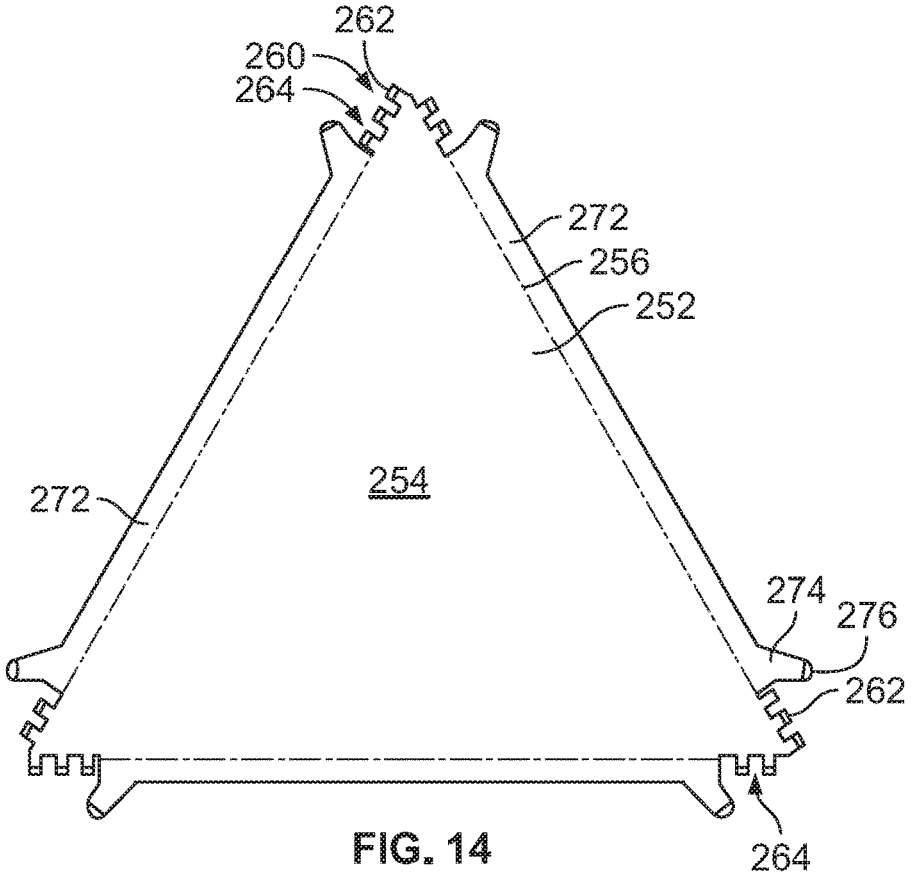
FIG. 14 illustrates a top plan view of a second example panel member of the second example movable panel array in an unformed configuration in accordance with various embodiments of the present disclosure.
Figure 15:
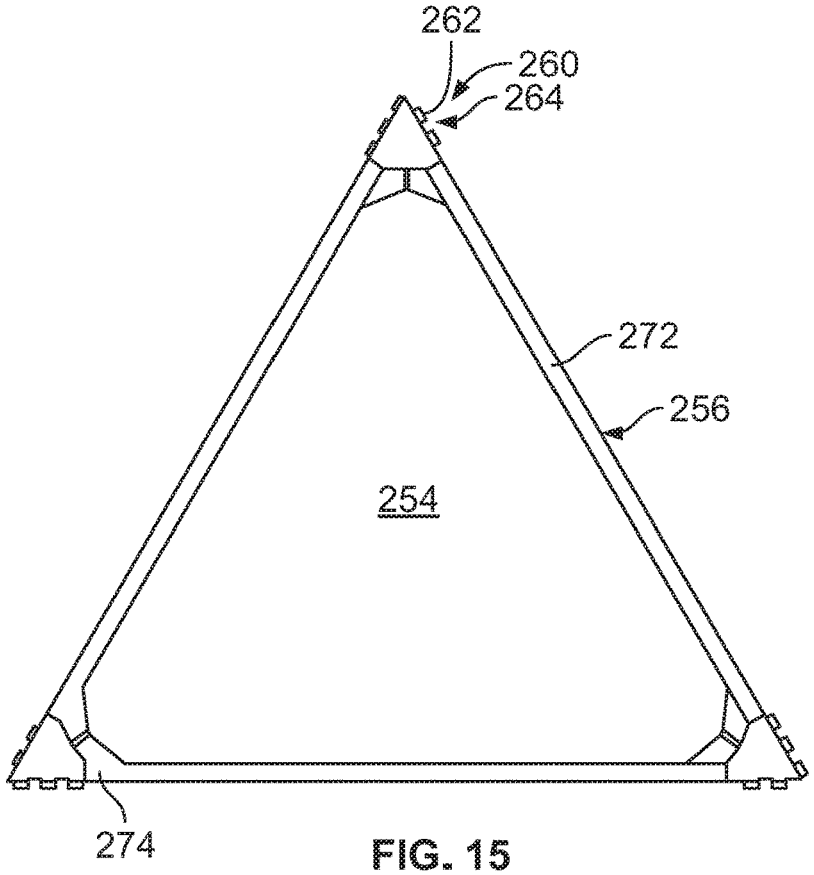
FIG. 15 illustrates a top plan view of the second example panel member of FIG. 14 in a formed configuration in accordance with various embodiments of the present disclosure.
Figure 16A:
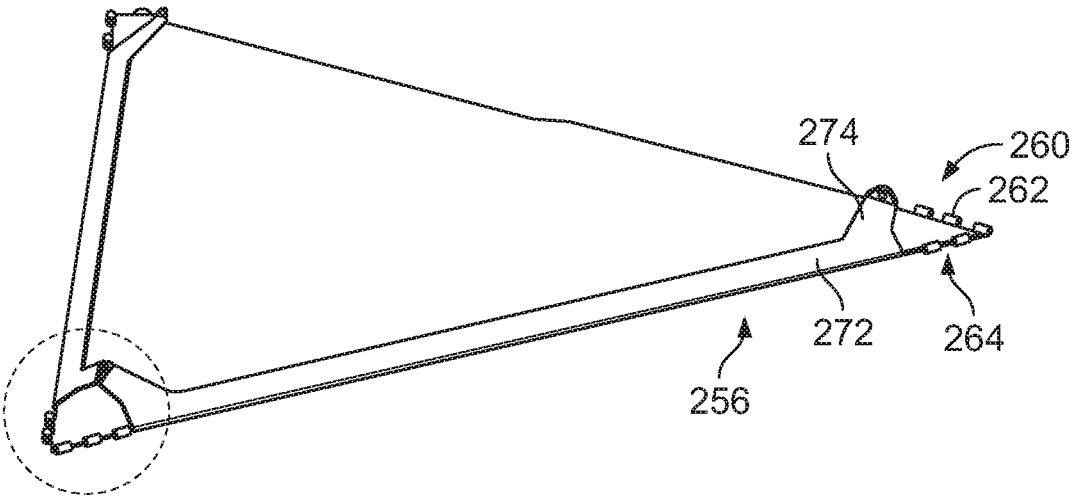
FIG. 16*a* illustrates a perspective view of the second example panel member of FIGS. 14 and 15 in the formed configuration in accordance with various embodiments of the present disclosure.
Figure 16B:
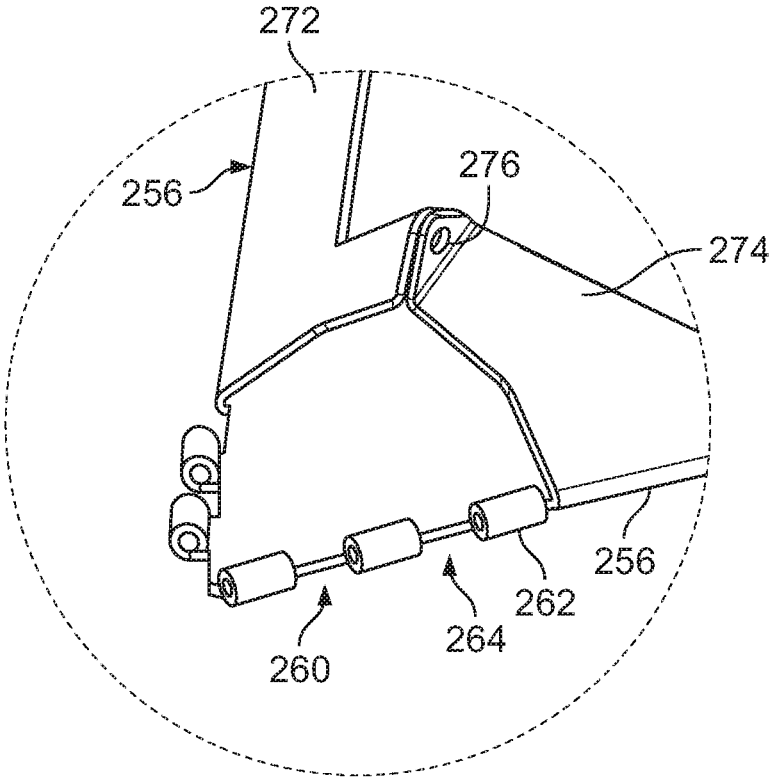
FIG. 16*b* illustrates a close up perspective view of the second example panel member of FIGS. 14-16*a* in a formed configuration in accordance with various embodiments of the present disclosure.

As illustrated in FIGS. 10 and 11, when adjacent panel members 152 are coupled to each other, the corners 156*a* of the adjacent panel members 152 define a clearance or opening 168. Any number of mounting structures 170 may be coupled with the first end 130*a* of the suspension members 130 to couple the movable panel array 150 to the suspension member 130 at any desired location of clearances 168. In the illustrated example, the mounting structure 170 is in the form of a ball 172 operably coupled to an eye hook 174. In some examples, the ball 172 may include a threaded opening that accepts a threaded portion of the eye hook 174 to secure the ball with the eye hook 174. Other examples are possible. The ball 172 is dimensioned to be larger than a dimension of the opening 168 while the eye hook 174 is dimensioned to be insertable through the clearance 168, and as such, by positioning the ball 172 below the clearance 168, a rotatable ball-and-socket joint is formed with the panel members 152 that allows the panel members 152 to rotate relative to the mounting structure 170.

Like the second end 130*b* of the suspension member 130, the first end 130*a* of the suspension member 130 may include a loop used to secure the first end 130*a* thereof to the eye hook 174. More specifically, in some examples, a shackle such as a carabiner (not illustrated) may be used to couple the mounting structure 170 with the first end 130*a* of the suspension member 130. Other examples of suitable coupling mechanisms are possible.

So configured, the panel array 150 is supported by the suspension members 130 via the mounting structures 170 at any desired clearance 168 location or locations. It is appreciated that a mounting structure 170 needn't be disposed at every clearance 168 location or location to adequately suspend the movable panel array 150. The length 130*c* of the suspension member 130 is supported by the pulley 118 (which is supported by the support structure 110). The relative positioning and/or length of the suspension members 130 that extends below the pulley 118 is retained via the set screw 136. Upon altering or modifying this length, such movement will cause the mounting structure 170 to raise or lower relative to the pulley 118, which in turn causes relative movement in the movable panel array 150 due to the hinged connection between adjacent panel members 152. As a result, the movable panel array 150 is movable in a tessellated fashion that causes the configuration and/or design of the movable panel array 150 to change.

A user may manually adjust the length of multiple suspension members 130 to create different patterns as desired. In some examples, such a modification can be achieved by hand, while in other examples, the second end 130*b* of the suspension members 130 may be coupled with a camshaft system (not illustrated) having lobes with varying profiles via any number of suitable approaches. The camshaft system may rotate according to predefined pattern to cause the movable panel array 150 to move according to a routine. Such a system may be manually engaged and/or may be driven by motor or other driving mechanism. Further, in some examples, the system may include a clutch to selectively disengage certain suspension members 130 as desired. Further still, in some examples, the system 100 may incorporate a controller (not illustrated) operably coupled with individual actuators used to adjust the length of the suspension members 130 individually, and/or as a group of suspension members 130. Other examples are possible.

Accordingly, the environment 101, and more specifically an area or footprint positioned under or near the movable panel array 150 can have desired insulative properties. In some examples, the movable panel array 150 may form a dome for use in quiet areas, may have reflective properties to reflect more sound to increase noise level if desired, and the like. Other examples are possible.

A second embodiment of a movable panel array 250 for the dynamic acoustic and aesthetic system 100 is illustrated in FIGS. 12-16*b*. It will be appreciated that the movable panel array 250 illustrated in FIGS. 12-16*b* may include similar features to the movable panel array 150, and accordingly, elements illustrated in FIGS. 12-16*b* are designated by similar reference numbers indicated in the embodiment illustrated in FIGS. 1-11 increased by 100. Accordingly, these features will not be described in substantial detail. Further, it is appreciated that any of the elements described with regards to the movable panel array 150 may be incorporated into the movable panel array 250.

In this embodiment, the panel members 252 include an integrated hinge member 260 and mounting structure 270, thereby eliminating the need for separate hinge and mounting components. More specifically, as illustrated in FIGS. 14-16*b*, the panel members 252 include a number of barrel portions 262 and a number of gap portions 264 positioned therebetween. Further, the panel members include a foldable portion 272 positioned at the edge 256 of the body 254 that includes an outwardly extending finger portion 274 having a mounting hole 276 extending therethrough. As before, the panel member 252 may be constructed from a formed and/or stamped metal material such as a polymeric material, glass, or any combination of these and/or other suitable materials, and the foldable portion 272 may subsequently be bent upwards (see FIGS. 13 and 15-16*b*). Upon bending the foldable portions 272, the edge 256 of each panel member 252 is defined and the barrel portions 262 extend outwardly therefrom. The finger portions 274 of opposing edges 256 abut each other, and the mounting holes 276 become aligned.

To couple adjacent panel members 252 to each other, edges 256 of two panel members 252 are positioned next to each other. Such a positioning causes the barrel portions 262 of a first panel member 252 to be inserted and aligned within the gap portion 264 of a second panel member 252. A hinge pin or similar structure may then be inserted into the barrel portions 262 to secure and retain the panel members 252 to each other.

After forming the movable panel array 250 using the desired number of panel members 252, a user may couple the first end of the suspension member with the mounting holes 276 at any desired location or locations, and can move the movable panel array 250 using any one or ones of the aforementioned approaches.

Figure 17A:
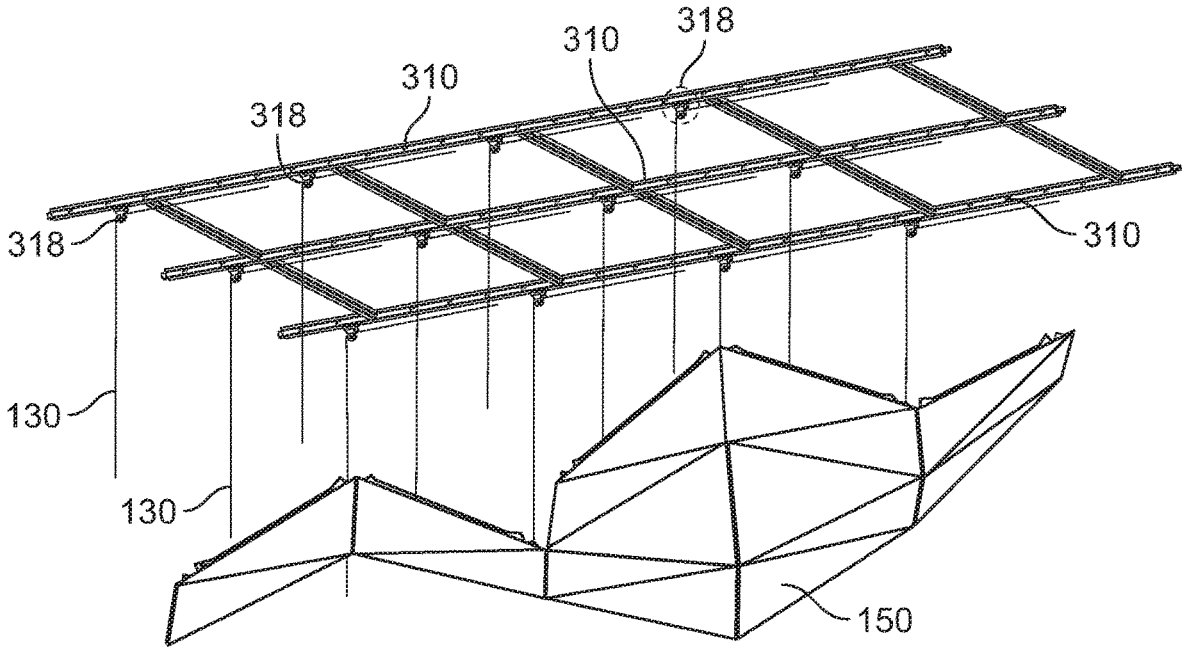
FIG. 17*a* illustrates a perspective view of a third example movable panel array including an alternative support structure in accordance with various embodiments of the present disclosure.
Figure 17B:
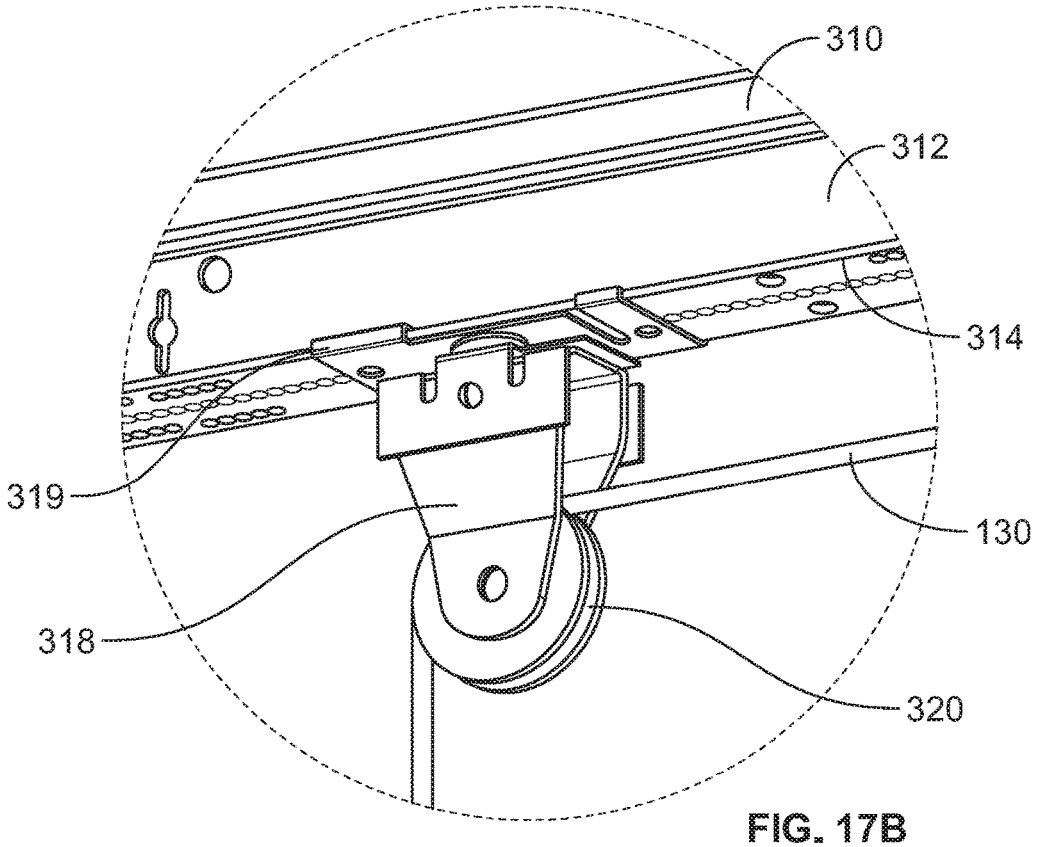
FIG. 17*b* illustrates a close-up perspective view of the alternative support structure of FIG. 17*a* in accordance with various embodiments of the present disclosure.

An alternative embodiment of a support structure 310 for the dynamic acoustic and aesthetic system 100 is illustrated in FIGS. 17*a* and 17*b*. It will be appreciated that the support structure 310 illustrated in FIGS. 17*a* and 17*b* may include similar features to the support structure 110, and accordingly, elements illustrated in FIGS. 17*a* and 17*b* are designated by similar reference numbers indicated in the embodiment illustrated in FIGS. 1-16*b* increased by 200. Accordingly, these features will not be described in substantial detail. Further, it is appreciated that any of the remaining elements described with regards to the system 100 may be incorporated into the embodiment illustrated in FIGS. 17*a* and 17*b*.

In this embodiment, the support structure 310 is in the form of a Tee Grid system where an elongated member 312 has a base 312 and a platform 314 extending therefrom. The platform 314 is in the form of a flange to which the pulley 318 connects. More specifically, the pulley 318 includes a mounting member 319 in the form of a swivel clip that is positioned such that it wraps around the platform 314 to allow for relative sliding movement between the pulley 318 and the platform 314. The main wheel 320 is rotatable relative to the mounting member 319.

So configured, the system 100 provides enhanced sound altering characteristics while increasing the visual appeal of the environment 101 as well as allowing an adjustable and changing appearance in the environment as desired with minimal effort. Such a system is tunable as desired to allow for an adjustable amount of reverb in certain situations (e.g., when the environment is less populated) and more absorptive in other situations (e.g., when the environment is more populated). Further, the system is tunable to provide a more open environment (e.g., by adjusting the assembly to be more flat) and to provide a more private and intimate environment (e.g., by adjusting the assembly to be more dome-shaped) as desired. Such a system 100 may be used in any number of desired environments such as, for example, restaurants, lobby or waiting areas, airports, meeting areas, entryways, hotels, and the like. The system 100 is easy to configure, install, and actuate, and can have additional capabilities and features if desired.

For example, the system 100 may incorporate any number of sensors and/or sound generating devices (not illustrated) operably coupled with a controller (not illustrated). Such a sound-generating device may be an electroacoustic transducer that generates sound to provide adjustable sound masking and/or sound reinforcement, depending on the desired application. In some examples, the sound-generating device may be a loudspeaker, a cluster of loudspeakers, distributed mode loudspeakers, and/or focused loudspeaker arrays.

The system 100 may further include a programmable controller such as a digital signal processor (DSP) that controls movement of the suspension members 130 and/or the sound-generating device. The DSP may include a communication link that communicates with the controller in a manner described below. In these examples, the controller may be in signal communication with at least one sensor located in the environment 101 at any desired location. Any number of additional sensors capable of sensing any number of characteristics of the environment 101 and/or the system 100 may be used and placed at desired locations.

The controller can be disposed in a number of positions with respect to the environment 101. As examples, the controller can be placed on a wall or in a discrete location. In some examples, the controller may be integral with the movable panel array 150, for example, the controller may be contained in an enclosure that is mounted on one of the panel members 152, contained in a separate enclosure that is positioned adjacent or proximate to the system 100, or can be positioned remotely. In some embodiments, the controller can partially or fully control functions of the system 100 via wired and/or wired signal communications as known and/or commonly used in the art.

The sensor may be any type of sensor adapted to measure (either directly or indirectly) one or more characteristics of the environment 101 and/or the movable panel array 150. The sensor may measure any environmental characteristic, such as, for example, a decibel level, a vibration level, a number of people in the environment, illumination levels, motion (e.g., via a Pyroelectric ("Passive") Infrared Sensors), temperatures, humidity, air flow, air particulates, gases such as carbon monoxide, air pressure, and/or electromagnetic disturbances, or any one or more of any number of additional characteristics which are indicative of these. Further still, sound (sonar) waves, radio waves, light waves (LIDAR), and computer vision may also be used to map and/or identify physical objects and/or people within the environment 101.

As an example, the sensor may be a microphone or array of microphones, though other examples are possible. When microphones are implemented, systems may be used to identify individual people using voice-recognition algorithms that identify unique voices. Such a system can be used in conjunction with speakers to generate a level sound volume throughout the environment 101 and/or to enhance the sound of human speech. Further, such a system may act as an intercom system, may be capable of responding to voice commands, and/or detect equipment failures.

The sensor generates a signal which is transmitted to an input of the controller. In some examples, the controller can be set, configured, and/or programmed with logic, commands, and/or executable program instructions to provide appropriate correction factors to estimate or calculate values for the measured characteristic in the environment 101.

The signal or signals from the controller may be used to control operation of the system 100 such that variations in environmental characteristics influencing decibel levels are taken into account by the controller. Adjustments may be made by the controller in real time or in near-real time (that is, with a minimal delay between sensors sensing values and changes being made to the system 100), or corrections can be made with some delay. Furthermore, historical data may be used as a basis for making adjustments to the system 100. The controller may be connected to the sensors and the DSP and/or any other components in the system 100 via any type of signal communication approach known in the art.

The controller may also be a DSP that includes software adapted to control its operation, any number of hardware elements (such as, for example, a non-transitory memory module and/or processors), any number of inputs, any number of outputs, and any number of connections. The software may be loaded directly onto a non-transitory memory module of the controller in the form of a non-transitory computer readable medium, or may alternatively be located remotely from the controller and be in communication with the controller via any number of controlling approaches. The software includes logic, commands, and/or executable program instructions which may contain logic and/or commands for controlling the movable panel array 150 according to a desired operational program. The software may or may not include an operating system, an operating environment, an application environment, and/or a user interface.

In some examples, a routine may be implemented on the controller that may or may not rely on sensed measurements. For example, the program may be time-based such that the active control elements of the movable panel array are activated and/or actuated at specific times (e.g., during busy periods within the environment 101).

Unless specified otherwise, any of the feature or characteristics of any one of the embodiments of the smart dynamic acoustic ceiling panels disclosed herein may be combined with the features or characteristics of any other embodiments of the smart dynamic acoustic ceiling panels.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

The patent claims at the end of this patent application are not intended to be construed under 35 U.S.C. § 112(f) unless traditional means-plus-function language is expressly recited, such as "means for" or "step for" language being explicitly recited in the claim(s). The systems and methods described herein are directed to an improvement to computer functionality, and improve the functioning of conventional computers.

What is claimed is:

1. A modular dynamic acoustic system for use in connection with one or both of an indoor environment or an outdoor environment, the modular dynamic acoustic system comprising:

a movable panel array including a plurality of panel members, each of the plurality of panel members including: a) a body defining at least one edge; b) at least one hinge positioned along the at least one edge; and c) at least one mounting structure, wherein each of the plurality of panel members are operably coupled with at least one adjacent panel member via the at least one hinge;

a support structure; and a plurality of suspension members, each of the plurality of suspension members being operably coupled with the support structure and the at least one mounting structure of one of the plurality of panel members to secure the movable panel array to the support structure, wherein each of the suspension members is movable to modify a configuration of the movable panel array, wherein the at least one mounting structure of each of the plurality of panel members comprises an opening formed between adjacent panel members.

2. The modular dynamic acoustic system of claim 1, wherein the at least one hinge of each of the plurality of panel members is integrally formed with the body and includes at least one barrel portion and at least one gap portion, wherein the at least one barrel portion of a first panel member is adapted to be disposed in the at least one gap portion of the adjacent panel member when operably coupled together.

3. The modular dynamic acoustic system of claim 1, wherein each of the plurality of panel members comprises a hinge mounting portion positioned along the at least one edge to secure the hinge to the panel member.

4. The modular dynamic acoustic system of claim 1, wherein the opening of the at least one mounting structure is adapted to receive a ball member including an eye bolt coupled thereto.

5. The modular dynamic acoustic system of claim 1, wherein the body of the plurality of panel members is constructed from a sound-absorbing material.

6. The modular dynamic acoustic system of claim 1, wherein each of the plurality of panel members has a triangular shape.

7. A movable panel array for a modular dynamic acoustic system, the movable panel array comprising:

a plurality of panel members, each of the plurality of panel members including: a) a body defining at least one edge; b) at least one hinge positioned along the at least one edge; and c) at least one mounting structure, wherein each of the plurality of panel members are operably coupled with at least one adjacent panel member via the at least one hinge, wherein the at least one mounting structure of each of the plurality of panel members comprises an opening formed between adjacent panel members.

8. The movable panel array of claim 7, wherein the at least one hinge of each of the plurality of panel members is integrally formed with the body and includes at least one barrel portion and at least one gap portion, wherein the at least one barrel portion of a first panel member is adapted to be disposed in the at least one gap portion of the adjacent panel member when operably coupled together.

9. The movable panel array of claim 7, wherein each of the plurality of panel members comprises a hinge mounting portion positioned along the at least one edge to secure the hinge to the panel member.

10. The movable panel array of claim 7, wherein the opening of the at least one mounting structure is adapted to receive a ball member adapted to be secured with a support structure, the ball member including an eye bolt coupled thereto.

11. The movable panel array of claim 10, wherein each of the plurality of panel members is rotatable relative to the ball member.

12. The movable panel array of claim 7, wherein the body of the plurality of panel members is constructed from a sound-absorbing material.

13. The movable panel array of claim 7, wherein each of the plurality of panel members has a triangular shape.

* * * * *